US005398358A

United States Patent [19]

Mercke et al.

[11] Patent Number: 5,398,358

[45] Date of Patent: * Mar. 21, 1995

[54] STRETCHER

[75] Inventors: R. Bruce Mercke; David K. Mercke; W. Chris Mercke, all of Louisville, Ky.

[73] Assignee: Junkin Safety Appliance Co., Louisville, Ky.

[ * ] Notice: The portion of the term of this patent subsequent to Sep. 21, 2010 has been disclaimed.

[21] Appl. No.: 969,566

[22] Filed: Oct. 30, 1992

[51] Int. Cl.[6] ..... A61G 1/00

[52] U.S. Cl. ..... 5/625; 5/628

[58] Field of Search ..... 5/625, 626, 628, 629; 128/870; 296/20

[56] References Cited

U.S. PATENT DOCUMENTS

| | | | |
|---|---|---|---|
| 1,795,435 | 3/1931 | Melzer | 5/625 X |
| 2,175,748 | 10/1939 | Dunn | 5/628 |
| 2,201,890 | 5/1940 | Dunn | 5/628 X |
| 2,400,426 | 5/1946 | Liptay et al. | 5/625 |
| 3,135,972 | 6/1964 | Oakes et al. | 5/629 X |
| 4,033,000 | 7/1977 | Bonifay | 5/625 X |

FOREIGN PATENT DOCUMENTS

| | | | |
|---|---|---|---|
| 1096012 | 12/1967 | United Kingdom | 5/625 |
| 2041764 | 9/1980 | United Kingdom | 5/628 |

*Primary Examiner*—Michael F. Trettel

[57] ABSTRACT

A stretcher or litter for transporting patients has a bottom peripheral frame rail and a top peripheral hand-grasp rail spaced above the bottom frame rail. A molded plastic patient-receiving container or basket is secured to the bottom frame rail so that the top peripheral hand-grasp rail is unobstructed.

12 Claims, 2 Drawing Sheets

STRETCHER

BACKGROUND OF THE INVENTION

The present invention relates to stretchers or litters for transporting injured people, and more particularly to a stretcher having a molded patient-receiving or carrying basket.

Stretchers of the above-identified class are, per se, known and examples are discussed in the following two U.S. Patents.

U.S. Pat. No. 3,135,972 issued on Jun. 9, 1964 shows a stretcher having a patient-receiving shell fabricated of a plastic material such as fiberglass. An aluminum tubing extends around the shell at the top edge and is secured to the tubing. The shell wall is formed with openings at the top edge thereof at spaced intervals to form hand-grasp holds. The shell is composed of segments so that the stretcher can be broken down into individual segments or transports.

U.S. Pat. No. 4,033,000 issued on Jul. 5, 1977 shows a stretcher having a patient-receiving shell of molded plastic. The stretcher also includes extensions at the head and foot ends of the shell which are formed with openings defining hand grips. In addition, the side wall of the shell is formed with slots for receiving patient-receiving straps therethrough.

Stretchers of the class discussed above can only be grasped at a limited number of preselected defined locations about the perimeter which makes it difficult to carry the stretcher in limited access areas such as mines, and difficult to manipulate the stretcher in uphill and downhill terrains.

SUMMARY OF THE INVENTION

The present invention recognizes the drawbacks of the heretofore known stretchers of the type discussed above and provides a straightforward solution.

The present invention provides a stretcher having a molded patient-receiving basket or container having a peripheral hand-grasp rail providing for the grasping of the stretcher at any location about the perimeter of the stretcher.

More particularly, the present invention provides a stretcher comprising a bottom peripheral frame, a peripheral hand-grasp rail generally conforming in peripheral shape to the peripheral shape of the bottom peripheral frame spaced above the bottom peripheral frame and substantially concentrically disposed to the bottom peripheral frame, bracket means interconnecting the top peripheral hand-grasp rail and the bottom peripheral frame, a molded plastic patient-receiving basket having a bottom wall and a peripheral side wall integral with the bottom wall, the peripheral shape of the top peripheral edge of the peripheral side wall conforming to the peripheral shape of the bottom peripheral frame, and a peripheral lip formed at the top peripheral edge of the peripheral side wall, the peripheral lip being positioned in peripheral juxtaposition to the bottom peripheral frame, and means for securing the peripheral lip to the peripheral side wall to the bottom peripheral frame.

BRIEF DESCRIPTION OF THE DRAWINGS

A better understanding of the present invention will be had upon reference to the following description in conjunction with the accompanying drawings wherein like numerals refer to like components throughout the several views and in which.

DETAILED DESCRIPTION OF THE PREFERRED EMBODIMENTS

Figure 2:
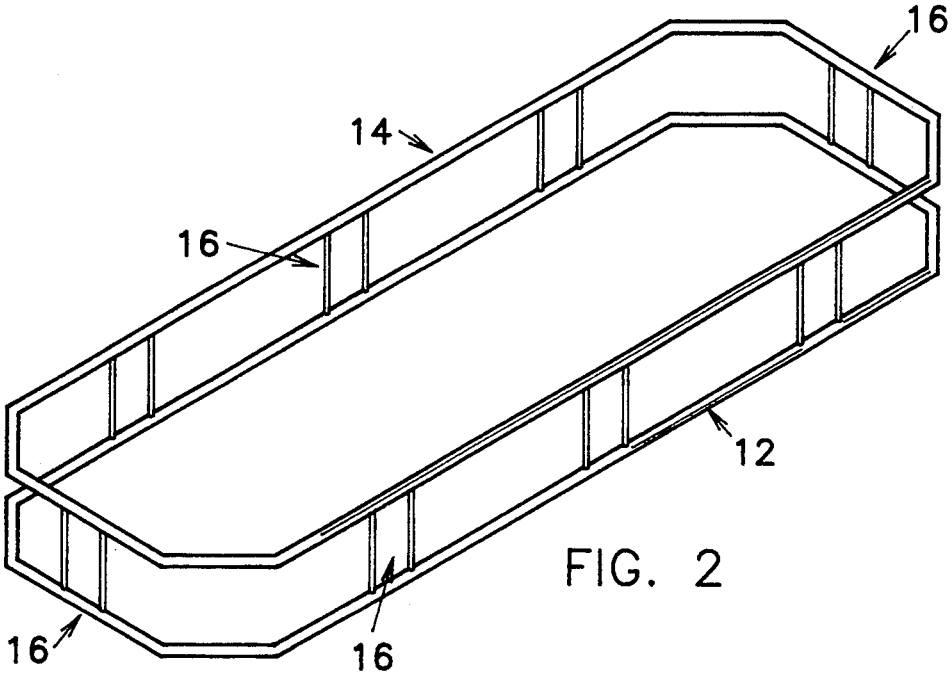
FIG. 2 is a perspective view of a component of the stretcher of FIG. 1.

With reference to FIGS. 1–5, there is shown a stretcher or litter, generally denoted as the numeral 10 of the present invention.

The stretcher 10 comprises a bottom peripheral frame 12 and a peripheral hand-grasp rail 14. The peripheral hand-grasp rail 14 generally conforms in peripheral shape and dimension to the peripheral shape and dimension of the bottom peripheral frame 12 and is spaced above the bottom peripheral frame 12 in substantial concentric relationship to the bottom peripheral frame 12. The bottom peripheral frame 12 and peripheral hand-grasp rail 14 are interconnected by bracket means 16. As shown, the bracket means 16 are spaced apart peripherally of the concentrically disposed bottom peripheral frame 12 and peripheral hand-grasp rail 14. As shown, the bracket means 16 comprises vertical posts, each secured at the bottom end to the bottom peripheral frame 12 and secured at the top end to the peripheral hand-grasp rail 14. Preferably, the bottom peripheral frame 12 and the peripheral hand-grasp rail 14 are of a tubular construction for strength and light weight. A preferred material for the bottom peripheral frame 12 and peripheral hand-grasp rail 14 is stainless steel.

The stretcher 10 also comprises a patient-receiving elongated basket or shell 18 sized and configured to receive and support the patient in a recumbent position. The basket 18 includes a bottom wall 20 and a peripheral side wall 22. The top peripheral edge, generally denoted as the numeral 24, of the basket side wall 22 substantially conforms in peripheral shape and peripheral dimension to the bottom peripheral frame 12. The side wall 22 includes a peripheral lip 26 at the top peripheral edge 24 projecting radially outwardly from the top peripheral edge 24. In a preferred embodiment, the basket 18 is unitary in construction, molded of a lightweight, rigid material such as high-density polyethylene. The basket 18 is located with the peripheral lip 26 in peripheral juxtaposition to the bottom peripheral frame 12 so that the basket 18 is suspended from the bottom peripheral frame 12. Preferably, the transverse cross-sectional shape or profile of the peripheral lip 26 conforms to the transverse cross-sectional shape or profile of the bottom peripheral frame 12. For example, wherein the bottom peripheral frame 12 is of a tubular construction, the profile of the lip 26 is preferably arcuate defining a peripheral channel receiving the tubular bottom peripheral frame 12 therein. The basket 18 is secured to the bottom peripheral frame 12 by securing means, generally denoted as the numeral 28. The securing means 28 are selected to be compatible with the material of the basket 18 and bottom peripheral frame 12. For example, the securing means 28 can be, fasteners such as screws, bolts and nuts, and rivets. It is also contemplated that the securing means 28 could also be a high-strength adhesive. In the preferred embodiment, as mentioned above, wherein the bottom peripheral frame 12 is a stainless steel tubular construction and the basket 18 is a molded plastic construction, it has been determined that stainless steel semi-tubular rivets are suitable securing means 18.

Figure 3:
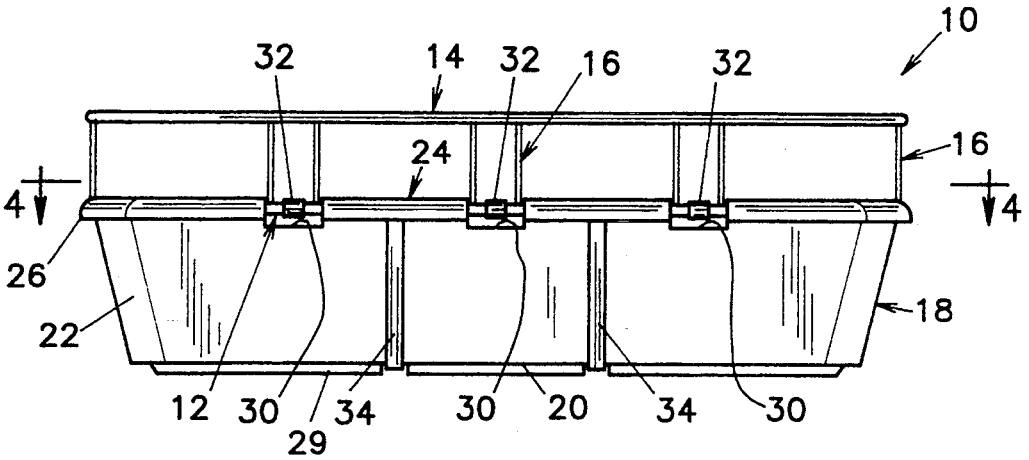
FIG. 3 is a side view of the stretcher of FIG. 1.
Figure 4:
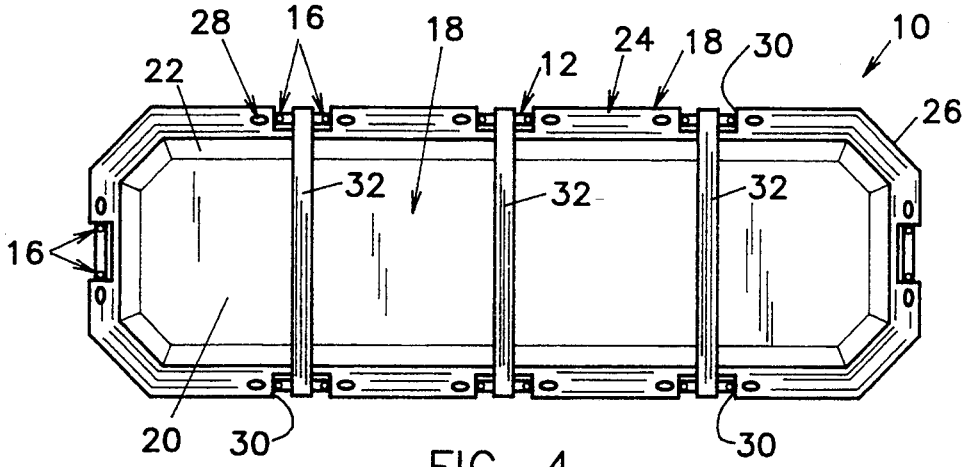
FIG. 4 is a top view of the stretcher of FIG. 1.
Figure 5:
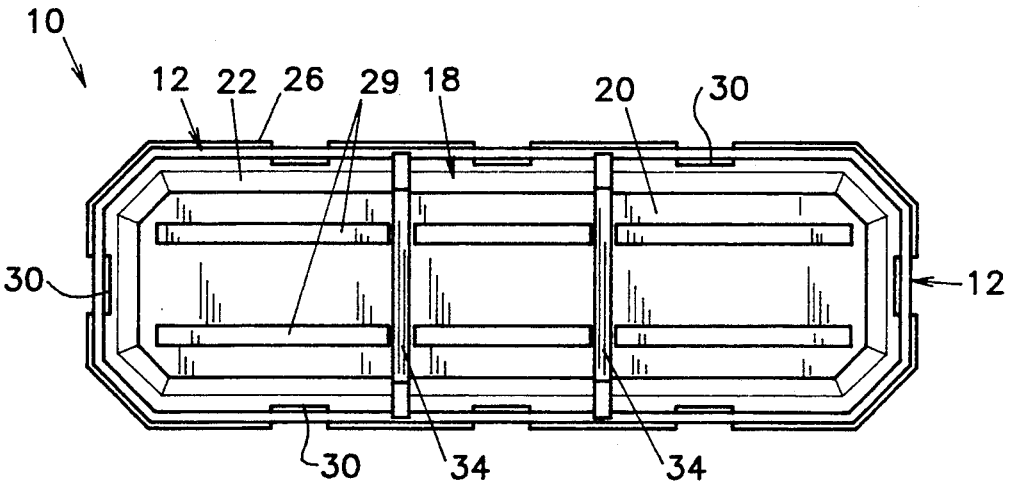
FIG. 5 is a bottom view of the stretcher of FIG. 1.

With reference to FIGS. 3 and 5, the basket 18 is formed with longitudinally extending, ground engaging runners 29 projecting outwardly from the bottom surface of the basket bottom wall 20. The runners 29 are unitary with the bottom wall 20 of the basket 18 and are preferably molded in the bottom wall 20. The runners 29 are advantageous when dragging the stretcher over, for example, snow-covered terrain.

Figure 1:
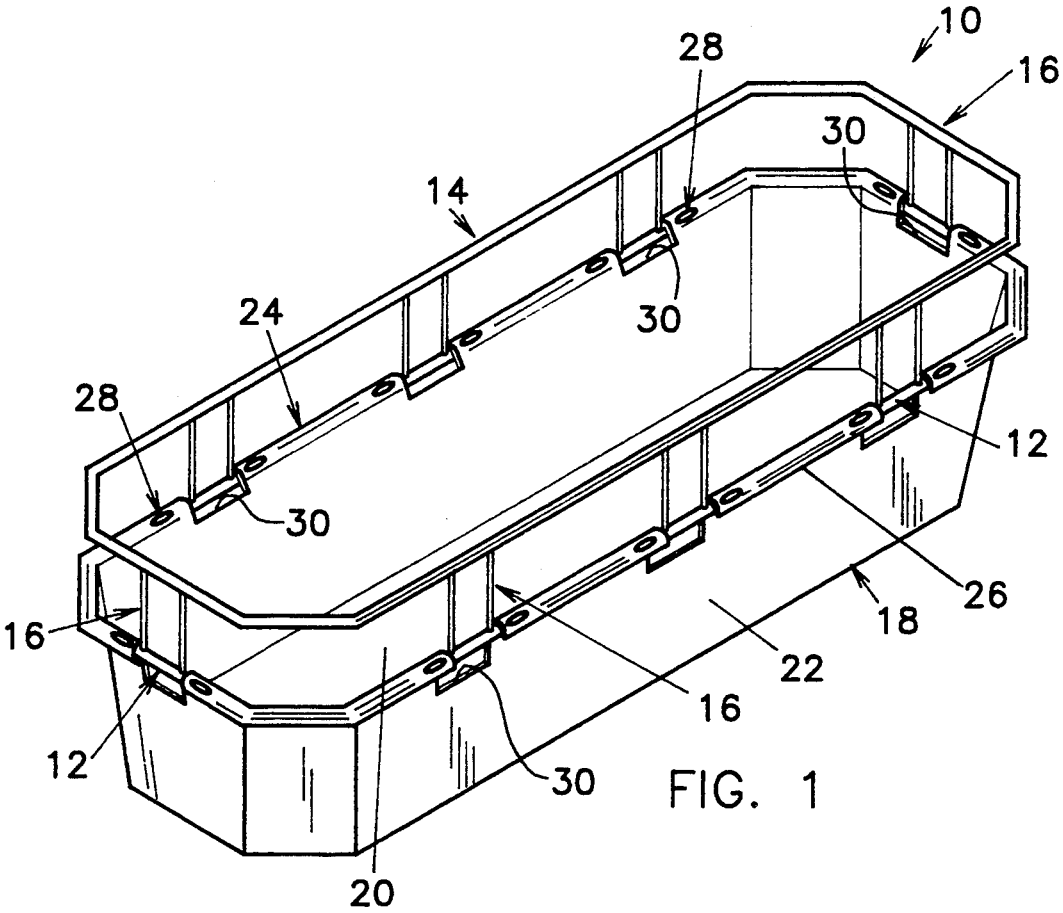
FIG. 1 is a perspective view of the stretcher of the present invention.

As can be best seen in FIGS. 1 and 3, the peripheral side wall 22 of the basket 18 is formed with a plurality of spaced-apart notches 30 in the longitudinal portions of the peripheral side wall open to the top edge 24 of the side wall 22 exposing portions of the bottom peripheral frame 12. The notches 30 are disposed in pairs, wherein the notches 30 of each pair are aligned transversely of the length of the basket 18. Patient-restraining straps 32 extending transversely of the length of the basket are fastened at their opposite ends to the portions of the bottom peripheral frame 12 exposed by the notches 30. Also, the locations of the bracket means 16 interconnecting the top peripheral hand-grasp rail 14 and bottom peripheral frame 12 coincide with the locations of the notches 30.

As can be best seen in FIGS. 3 and 5, the stretcher 10 further comprises basket reinforcing straps 34 which extend transversely of and beneath the basket 18 in contact with the side wall 22 and bottom wall 20 of the basket 16. The opposite ends of each reinforcing strap 34 are secured to the bottom peripheral frame 12 at opposite longitudinal sides of the frame 12. The reinforcing straps 34 can be fabricated of stainless steel and secured to the peripheral frame 12 by, for example, a weld.

The stretcher 10 of the present invention provides numerous advantages over heretofore known stretchers of the type having molded plastic patient-receiving baskets or shells. The peripheral hand-grasp rail 14 is unobstructed and provides for grasping the stretcher 10 at any location about the perimeter of the stretcher 10. The peripheral hand-grasp rail 14 being interconnected to the bottom peripheral frame 12 also functions to further structurally reinforce the stretcher 10.

The foregoing detailed description is given primarily for clearness of understanding and no unnecessary limitations are to be understood therefrom for modifications will become obvious to those skilled in the art upon reading this disclosure and may be made without departing from the scope of the inventions or scope of the appended claims.

We claim:

1. A litter or stretcher, comprising:

a. a bottom peripheral frame;

b. a top peripheral hand-grasp rail generally conforming in peripheral shape to the peripheral shape of the bottom frame, spaced above the bottom frame, and substantially concentrically disposed to the bottom frame;

c. bracket means interconnecting the top hand-grasp rail to the bottom peripheral frame;

d. a molded plastic patient-receiving basket having a bottom wall and a peripheral side wall integral with the bottom wall, the peripheral shape of the top peripheral edge of the peripheral side wall generally conforming to the peripheral shape of the bottom peripheral frame, and a peripheral lip formed at the top peripheral edge of the peripheral side wall, the peripheral lip being positioned in peripheral juxtaposition to the bottom peripheral frame; and, e. means for securing the peripheral lip of the basket peripheral side wall to the bottom peripheral frame.

2. The stretcher of claim 1, wherein the peripheral dimension of the peripheral lip at the top peripheral edge of the basket side wall is substantially equal to the peripheral dimension of the bottom peripheral frame.

3. The stretcher of claim 1, wherein the peripheral lip at the top peripheral edge of the peripheral side wall of the basket conforms in transverse cross-sectional shape to the transverse cross-sectional shape of the bottom peripheral frame defining a peripheral channel receiving the bottom peripheral frame.

4. The stretcher of claim 3, wherein:

a. the bottom peripheral frame is generally cylindrical in transverse cross-sectional shape; and, b. the peripheral lip at the top peripheral edge of the peripheral side wall of the container is generally arcuate in transverse cross-sectional shape.

5. The stretcher of claim 1, wherein the peripheral side wall of the basket is formed with a plurality of notches spaced apart peripherally of the side wall and open to the top edge of the side wall exposing portions of the bottom peripheral frame.

6. The stretcher of claim 5, further comprising patient-restraining straps securable to the portions of the bottom peripheral frame exposed at the notches in the side wall.

7. The stretcher of claim 5, wherein the location of the bracket means at the bottom frame coincide with the location of the notches.

8. The stretcher of claim 1, further comprising basket reinforcing straps extending transversely of and beneath the basket, the ends of each strap being secured to the bottom peripheral frame.

9. The stretcher of claim 1, wherein the basket is formed with longitudinally extending ground-engaging runners projecting outwardly from the bottom surface of the bottom wall.

10. The stretcher of claim 9, wherein the runners are unitary with the bottom wall of the basket.

11. The stretcher of claim 10, wherein the runners are molded in the bottom wall of the basket.

12. The stretcher of claim 1, wherein the basket is molded of high-density polyethylene.

* * * * *